US007631753B1

(12) United States Patent
Temmel

(10) Patent No.: US 7,631,753 B1
(45) Date of Patent: Dec. 15, 2009

(54) SOCK ORGANIZING APPARATUS

(76) Inventor: Thomas G. Temmel, 104 Sable Isle Ct., Sanford, FL (US) 32773

( * ) Notice: Subject to any disclaimer, the term of this patent is extended or adjusted under 35 U.S.C. 154(b) by 831 days.

(21) Appl. No.: 11/150,656

(22) Filed: Jun. 13, 2005

(51) Int. Cl.
*A45C 11/00* (2006.01)
*A44B 9/00* (2006.01)
*B42F 17/00* (2006.01)

(52) U.S. Cl. ..... 206/290; 24/DIG. 29; 211/49.1; 223/85

(58) Field of Classification Search ..... 206/278, 206/290, 300; 211/10, 49.1, 85.3; 223/85; 24/DIG. 29
See application file for complete search history.

(56) References Cited

U.S. PATENT DOCUMENTS

| | | | | | |
|---|---|---|---|---|---|
| 1,097,799 | A | * | 5/1914 | Godtfredsen | 211/49.1 |
| 2,482,003 | A | * | 9/1949 | Kauffman | 211/85.3 |
| 3,456,262 | A | | 7/1969 | Coon | |
| 3,673,639 | A | * | 7/1972 | Driscoll | 24/16 PB |
| 3,972,094 | A | * | 8/1976 | Fuller | 211/85.3 |
| 4,010,879 | A | * | 3/1977 | George et al. | 223/96 |
| 5,147,119 | A | * | 9/1992 | Harris | 312/49 |
| D353,245 | S | | 12/1994 | Tucker | |
| 5,381,588 | A | * | 1/1995 | Nelson | 24/30.5 S |
| 5,386,910 | A | * | 2/1995 | Liss | 206/554 |
| 5,440,791 | A | | 8/1995 | Guio | |
| 5,499,431 | A | | 3/1996 | Mortensen et al. | |
| D384,459 | S | | 9/1997 | Eisenman | |
| 5,740,944 | A | * | 4/1998 | Crawford | 221/134 |
| 5,944,236 | A | | 8/1999 | Cinque | |
| 6,176,378 | B1 | * | 1/2001 | Neubauer et al. | 211/113 |
| 6,389,657 | B1 | * | 5/2002 | Turner | 24/334 |
| 6,588,633 | B1 | * | 7/2003 | Ammann | 223/87 |
| 2006/0143780 | A1 | * | 7/2006 | Brian | 2/120 |

* cited by examiner

*Primary Examiner*—Sue A Weaver

(57) ABSTRACT

An apparatus includes a receptacle that has monolithically formed and bifurcated front and rear portions. The front and rear portions include an open top section and defines a cavity therein. The front portion has a linear slot formed medially therein and extending parallel downwardly along a longitudinal axis of the receptacle. Color-coded sock clips are included for holding paired socks together. The clips are formed from waterproof and heat resistant material such that the socks secured thereto can be laundered in conventional washing and drying machines. The clips are positional along the slot so that the clips and associated socks are vertically stacked in the receptacle. Fastening members are positional through the rear portion and into a wall surface for supporting the receptacle at an elevated position.

15 Claims, 5 Drawing Sheets

SOCK ORGANIZING APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to organizing apparatuses and, more particularly, to a sock organizing apparatus for sorting and washing paired socks.

2. Prior Art

Even with today's modern automated appliances, time has become more and more precious. One of the more onerous tasks required of the typical household is that of periodic laundry. While automated washers and dryers have simplified this chore, it still requires the sorting of clothing and other washable articles into various types according to color and other properties, and requires further sorting when the laundry is done to place the clean clothing or articles in the proper area. While this part of the chore may be readily accomplished with most clothing articles, it nevertheless requires additional time, and in some cases a fair amount of care is required to properly sort some paired articles which may have a similar appearance between different individual units.

Socks, stocking, and the like are a prime example, as oftentimes such clothing articles tend to be conservatively colored or patterned, and great care must be taken to preclude the mismatching of individual articles. While various devices have been developed to provide for such pairing of socks and the like for easy and convenient laundering and/or storage, they suffer from various deficiencies as will be discussed below.

One example discloses a clip formed of two mating and interlocking stampings of sheet material. The relative thinness of the material required for the interlocking portion of the clip requires that the portions be formed of a relatively durable material such as metal, which would not be suitable for the environment of the present invention due to its tendency to rust in moist conditions and to scratch or mar the interior of the washer and dryer drums when placed therein. Moreover, no additional means of improving the grip of the jaws is disclosed, which would likely result in slippage and disengagement from the article held therein during a washing or drying cycle, thus overcoming the purpose of the invention.

Another example discloses an aneurism clip formed of a single piece of titanium or titanium alloy. The deficiencies of such a metal clip used in the environment of the present invention have been noted above in the discussion of the previous clip example. Moreover, the relatively narrow, rod-like jaws do not appear to provide the distribution of force desirable to preclude crushing of the fabric. A further example discloses a sock palter and holder including a loop that has a pin at one end and a cooperating socket at the opposite end. The article(s) secured thereby are punctured by the pin, and thus unfortunately damaged, by using the device.

Accordingly, a need remains for a sock organizing apparatus in order to overcome the above-noted shortcomings. The present invention satisfies such a need by providing a sock organizing apparatus that is easy to use, durable in design, safe to deploy in a washer and dryer, provides considerable time and money savings, and is light weight, compact and portable in construction. Such a sock organizing apparatus solves the age-old problem of socks mysteriously disappearing during washing and drying procedures. The apparatus effectively holds pairs of socks together in the washer and/or dryer, and also during storage thereof. Such an apparatus is appreciable by a wide demographic of people due to the time and money it saves that is otherwise spent attempting to replace mismatched or lost socks.

BRIEF SUMMARY OF THE INVENTION

In view of the foregoing background, it is therefore an object of the present invention to provide a sock organizing apparatus. These and other objects, features, and advantages of the invention are provided by a sock organizing apparatus for sorting and washing paired socks.

The apparatus includes a receptacle that has monolithically formed and bifurcated front and rear portions, wherein a volume of the front portion may be less than a volume of the rear portion. A plurality of fastening members are directly positional through the rear portion and into a wall surface for effectively and conveniently supporting the receptacle at an elevated position.

Each of the front and rear portions includes a top section that has an opening formed therein and defines a cavity for receiving clothes. The front and rear portions each may have a face providing a generally concave shape such that alternate pairs of socks secured by the clips can effectively be stacked directly within the front portion while the clips lay juxtaposed in the slot to provide increased storage capability and easy access.

Such a front portion has a slot formed medially therein and extending downwardly along a partial longitudinal height of the apparatus. The linear slot extends substantially parallel to a longitudinal axis of the receptacle. Such a slot preferably includes a lip portion defined along a perimeter thereof. The front portion preferably has a longitudinal height less than a longitudinal height of the rear portion such that a user can advantageously easily position the clips in the slot of the front portion.

A plurality of color-coded sock clips are included for effectively and conveniently holding paired socks together. Such clips are formed from waterproof and heat resistant material such that the socks secured thereto can conveniently be laundered in conventional washing and drying machines respectively. The clips are directly positional along the slot such that the clips and associated socks are vertically stacked in the receptacle.

The sock clips may include a plurality of pivotally connected and coextensive jaw members. Such jaw members are adaptable between open and closed position for receiving and securing pairs of socks such that the socks can effectively be maintained at a substantially stable position during washing or storage.

An annular disc has a monolithically formed shaft protruding orthogonally therefrom. Such a shaft is directly conjoined to the jaw members. The disc is suitably sized and shaped such that a user can removably and slidably position the clips within the slot in such a manner that the socks can conveniently be stored within the cavity of the front portion of the apparatus.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
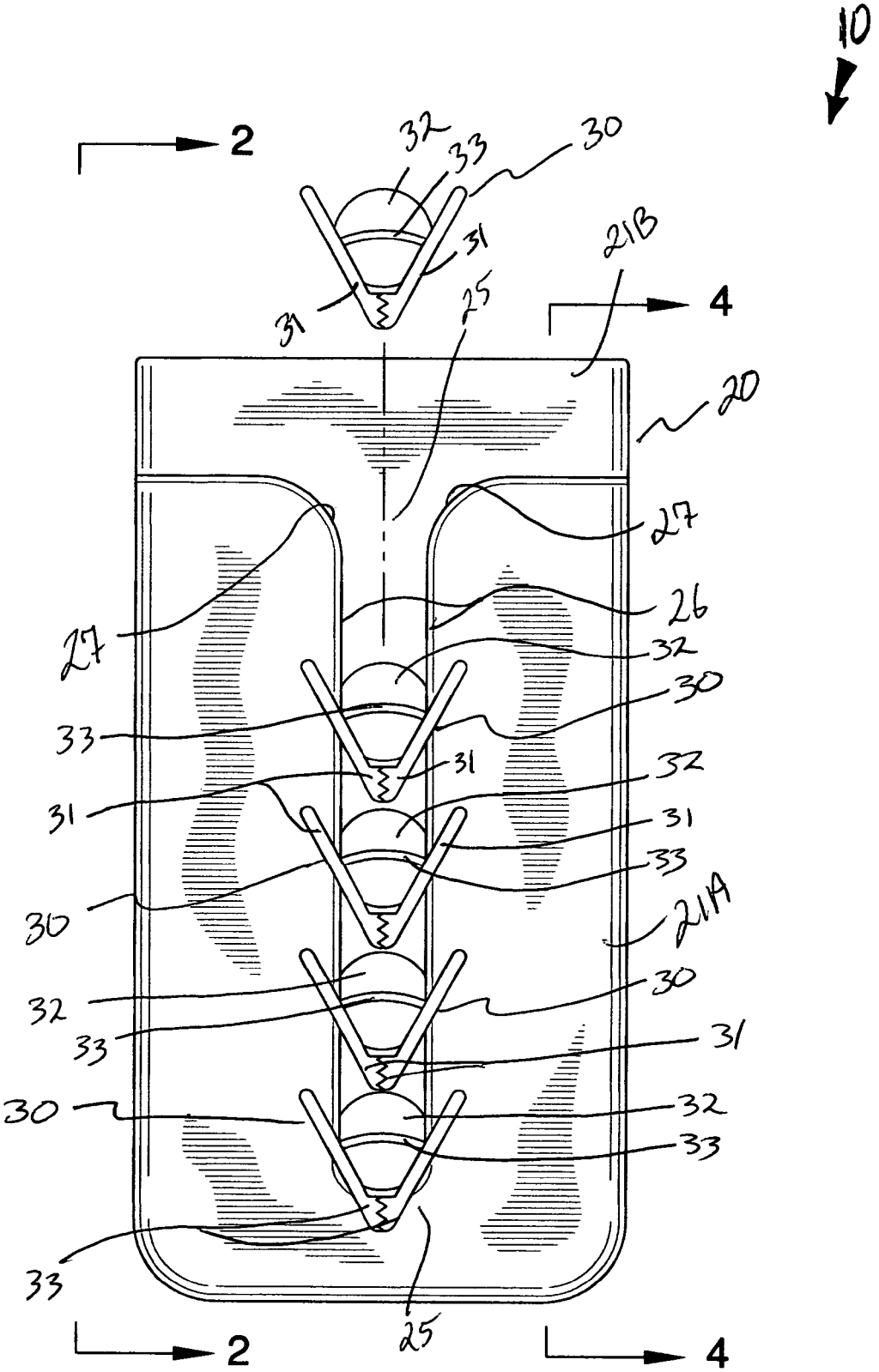
FIG. 1 is a front-elevational view showing a sock organizing apparatus, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a sock organizing apparatus. It should be understood that the apparatus 10 may be used to hold together many different types of paired clothing items and should not be limited in use to only pairs of socks.

Figure 4:
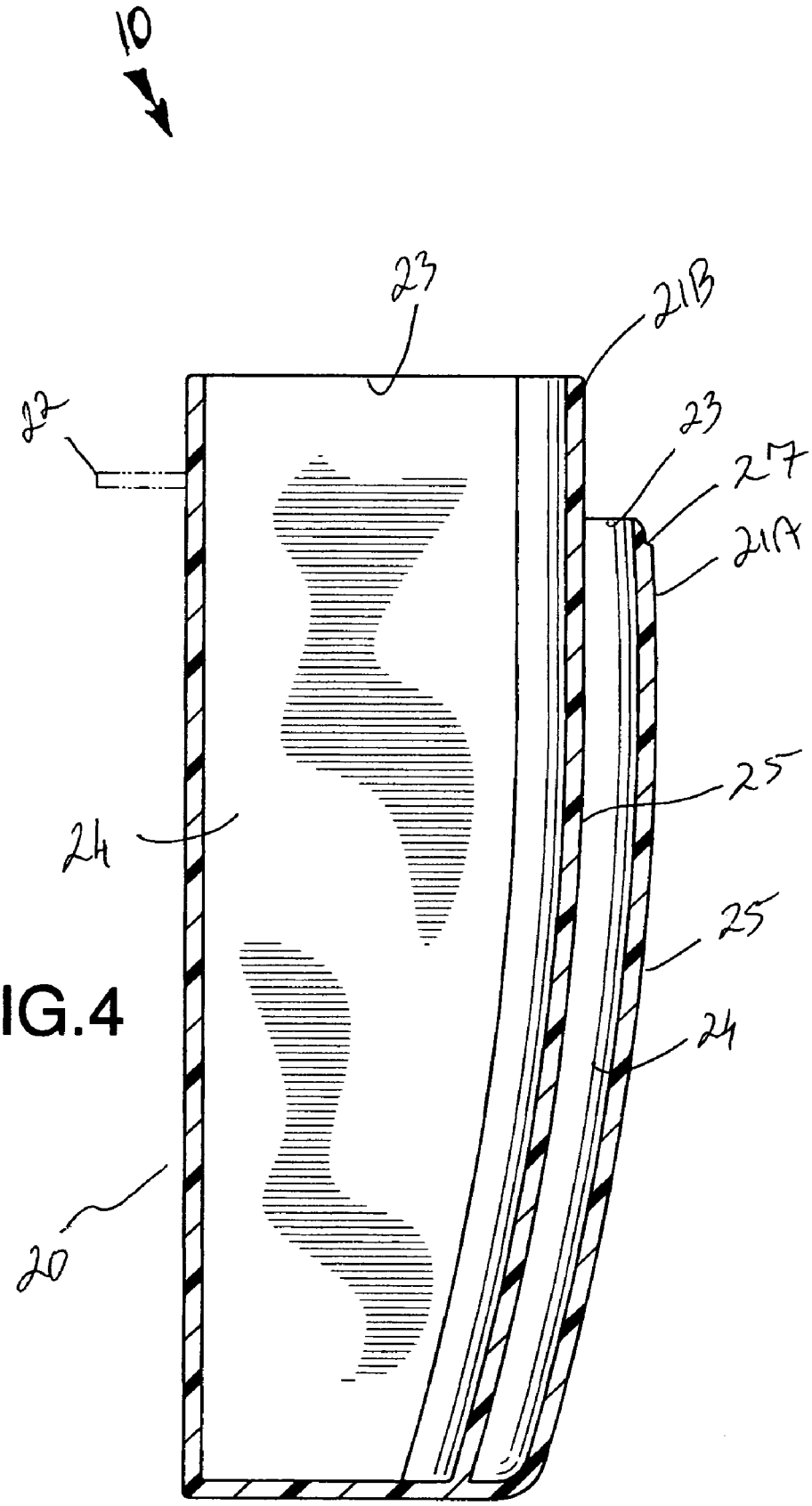
FIG. 4 is a cross-sectional view of the apparatus shown in FIG. 1, taken along line 4-4.

Referring initially to FIGS. 1 and 4, the apparatus 10 includes a receptacle 20 that has monolithically formed and bifurcated front 21A and rear 21B portions, wherein a volume of the front portion 21A is less than a volume of the rear portion 21B, as is best shown in FIG. 4. Of course, the front 21A and rear 21B may have alternate volumes with respect to one another, as is obvious to a person of ordinary skill in the art. A plurality of fastening members 22 are directly positional, with no intervening elements, through the rear portion 21B and into a wall surface 11, which is essential and advantageous for effectively and conveniently supporting the receptacle 20 at an elevated position. Such fastening members further allow the apparatus 10 to be suspended from a variety of convenient locations depending on the user's needs, whether it be in the laundry room, a bedroom, a closet etc. Of course, alternate fastening members 22, such as adhesive or magnetic strips, may be used by the apparatus 10, as is obvious to a person of ordinary skill in the art.

Figure 3:
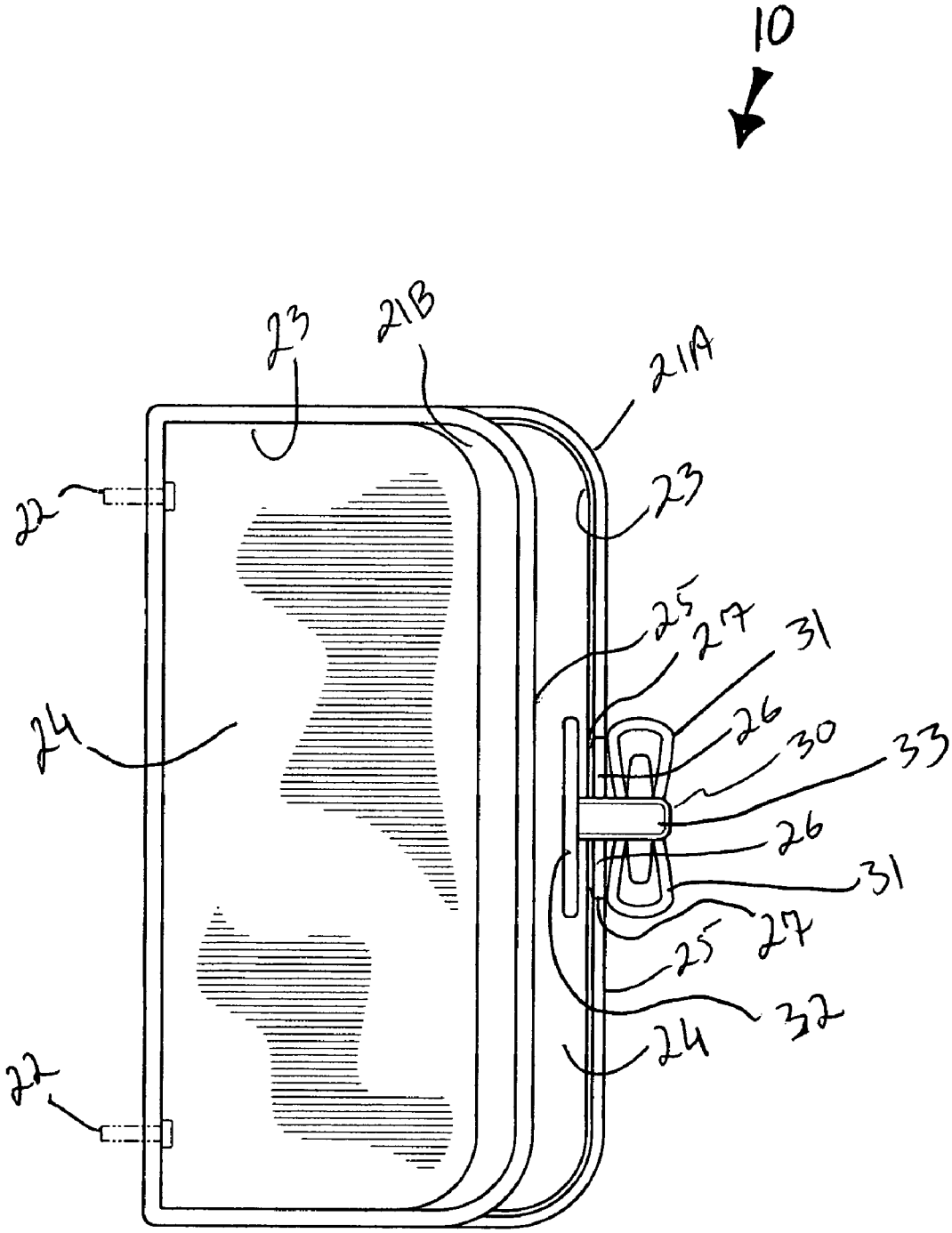
FIG. 3 is a top plan view of the apparatus shown in FIG. 1, taken along line 3-3 and showing the open top sections of the front and rear portions.

Referring to FIGS. 3 and 4, each of the front 21A and rear 21B portions includes a top section 23 that has an opening formed therein and defines a cavity 24 that is critical for effectively receiving and storing clothes therein. The front 21A and rear 21B portions have a face 25 provided with a generally concave shape such that alternate pairs of socks secured by the clips 30 (described herein below) can effectively be stacked directly, with no intervening elements, within the front portion 21B while the clips 30 lay juxtaposed in the slot 26 (described herein below), which is crucial and convenient for providing increased storage capability and easy access.

Referring to FIGS. 1 and 3, such a front portion 21A has a slot 26 formed medially therein and extending downwardly along a partial longitudinal height of the apparatus 10. The linear slot 26 extends substantially parallel to a longitudinal axis of the receptacle 20. Such a slot 26 includes a lip portion 27 defined along a perimeter thereof that is crucial and advantageous for effectively guiding the clips 30 along the slot 26. The front portion 21A has a longitudinal height less than a longitudinal height of the rear portion 21B, which is important such that a user can advantageously easily position the clips 30 in the slot 26 of the front portion 21A.

Referring to FIGS. 1, 2, 3 and 5, a plurality of color-coded sock clips 30 are included for effectively and conveniently holding paired socks together. The color coded nature advantageously allows a user to further conveniently distinguish between the various pairs of socks of different members of a household, or among roommates. Such clips 30 are formed from waterproof and heat resistant material, which is essential such that the socks secured thereto can conveniently be laundered in conventional washing and drying machines respectively without causing damage to the machines. The clips 30 are directly positional, with no intervening elements, along the slot 26 such that the clips 30 and associated socks are vertically stacked in the receptacle 20.

Still referring to FIGS. 1, 2, 3 and 5, the sock clips 30 include a plurality of pivotally connected and coextensive jaw members 31. Such jaw members 31 are adaptable between open and closed positions, which are vital for receiving and securing pairs of socks such that the socks can effectively be maintained at a substantially stable position during washing or storage thereof. Such jaw members 31 advantageously do not cause physical damage to the socks during washing, drying and/or storage procedures, thus providing an improvement over conventional sock organizing apparatuses.

Figure 2:
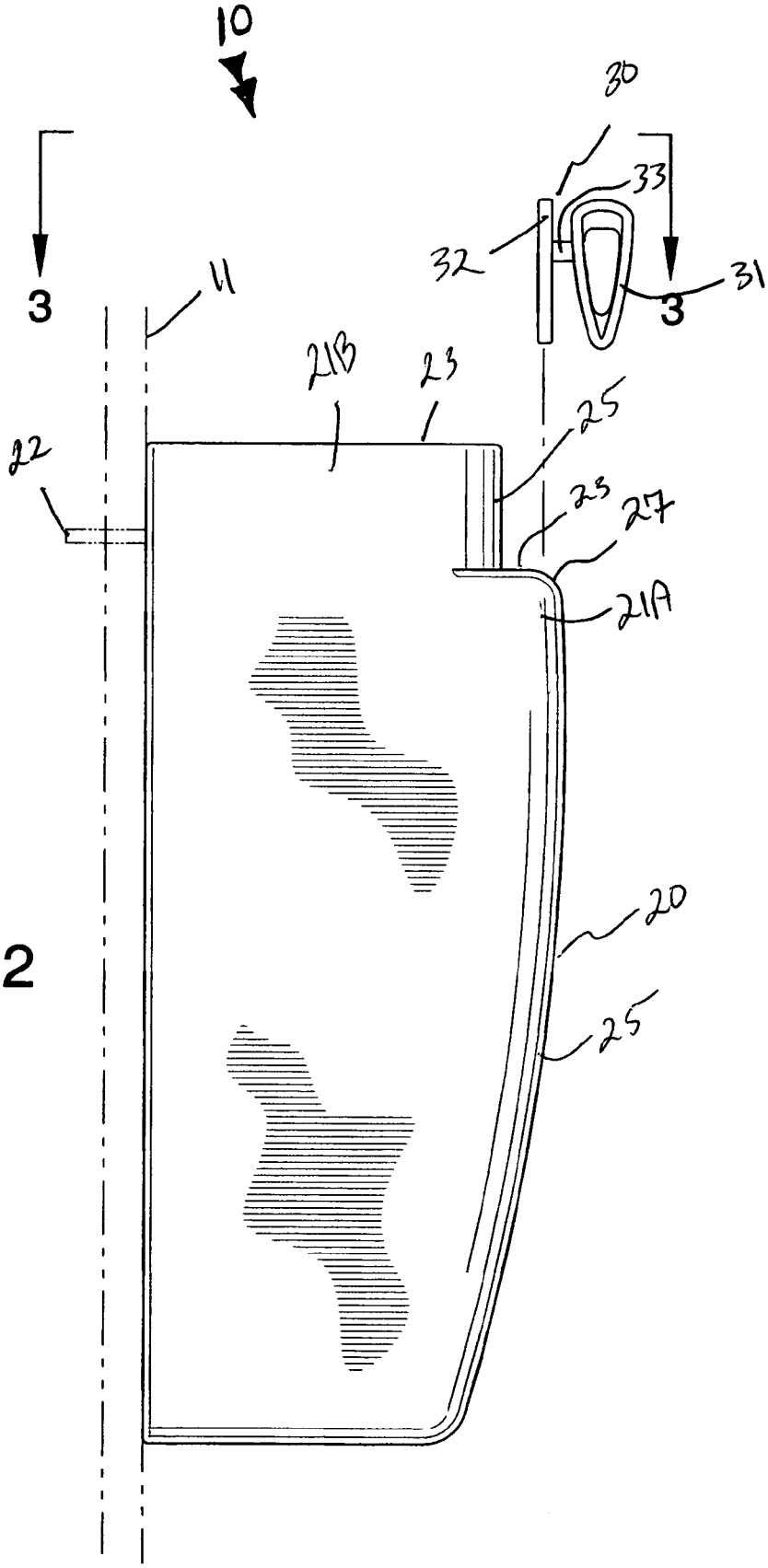
FIG. 2 is a side-elevational view of the apparatus shown in FIG. 1, taken along line 2-2.

Again referring to FIGS. 1, 2, 3 and 5, an annular disc 32 has a monolithically formed shaft 33 protruding orthogonally therefrom. Such a shaft 33 is directly conjoined, with no intervening elements, to the jaw members 31, as is best shown in FIGS. 2 and 3. The disc 32 is suitably sized and shaped such that a user can removably and slidably position the clips 30 within the slot 26 in such a manner that the socks can conveniently be stored within the cavity 24 of the front portion 21A of the apparatus 10. The disc 32 further advantageously prevents suspended socks from pivoting the sock clips 30 forwardly and away from the receptacle 20, thus keeping the socks clean after being washed and dried.

Figure 5:
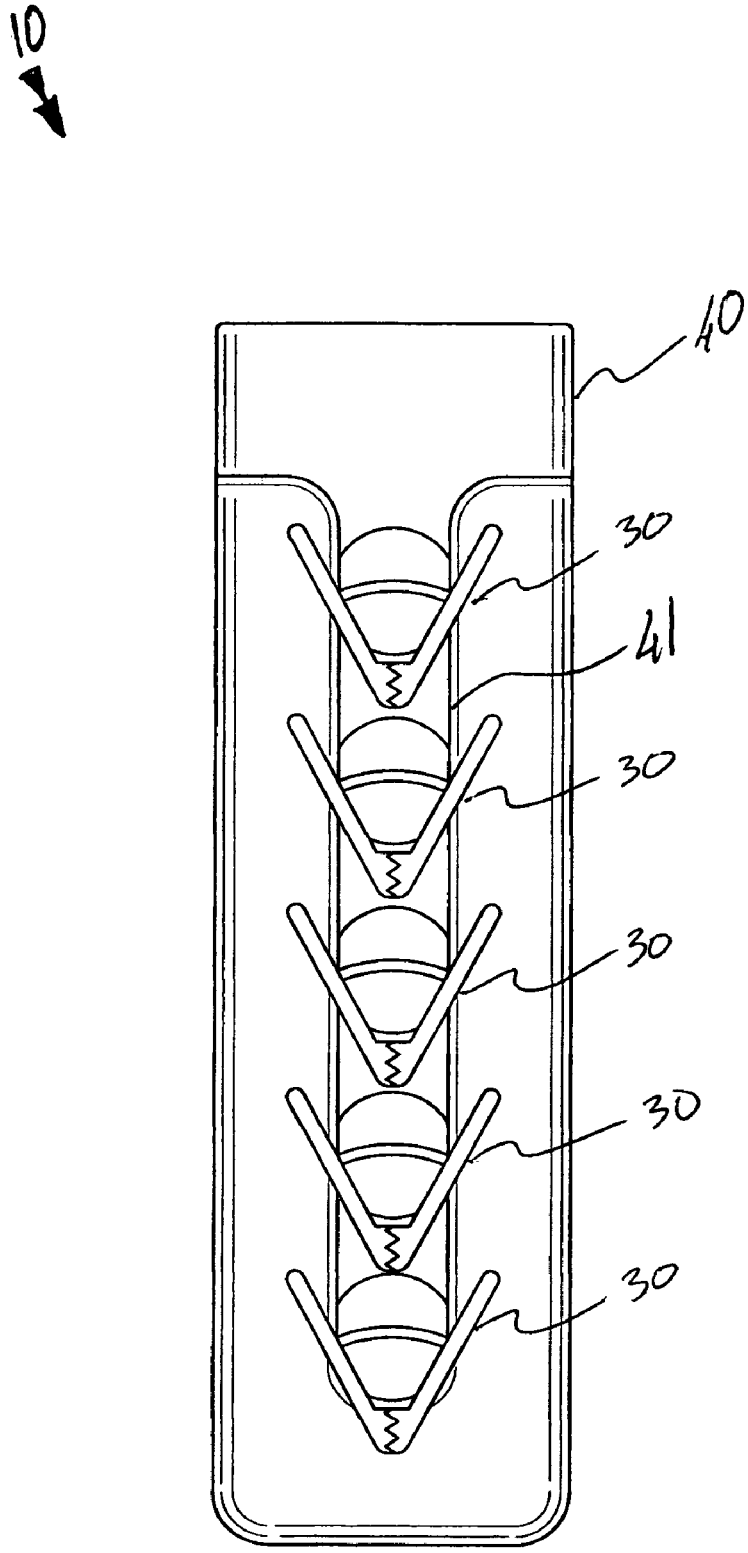
FIG. 5 is a front-elevational view showing an auxiliary receptacle, in accordance with the present invention.

Referring to FIG. 5, the apparatus 10 further includes an auxiliary receptacle 40 that has a substantially rectangular shape and can be suspended from a support surface in a similar fashion as the central receptacle 20. Such an auxiliary receptacle 40 allows dirty socks to be collected from a variety of locations, such as one's bedroom or bathroom. The auxiliary receptacle 40 includes a linear slot 41 that extends substantially parallel to a longitudinal axis thereof. Such a slot 41 is capable of receiving and suspending the sock clips 30 in a similar fashion as the central receptacle 20, thus providing a convenient collection point for dirty socks prior to washing and drying thereof.

In use, a person simply attaches the receptacle 20 to a support surface, such as a laundry room wall, and the auxiliary receptacles 40 to a bedroom or bathroom wall. Of course, the auxiliary receptacle 40 may be directly suspended within a laundry hamper, as is obvious to a person of ordinary skill in the art. A user can then clip pairs of socks together according to the various color codes, fasten the sock clip 30 in place, and place the socks in their respective auxiliary docks. The auxiliary receptacles 40 may be produced in colors corresponding to that of a specific sock clip color, so as to assist in the sorting of socks after washing and drying procedures, as is obvious to a person of ordinary skill in the art. In the case of dirty sock pairs, the sock clip 30, with attached socks, is thrown directly into the washer and then into the dryer, thus keeping the socks paired during these laundering cycles and preventing the loss or misplacement of one or both socks.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A sock organizing apparatus for sorting and washing paired socks, said apparatus comprising:

a receptacle having monolithically formed and bifurcated front and rear portions, each said front and rear portions including a top section having an opening formed therein and defining a cavity, said front portion having a slot formed medially therein and extending downwardly along a partial longitudinal height of said apparatus;

a plurality of sock clips, said clips being formed from waterproof and heat resistant material, said clips being directly positional along the slot such that said clips are vertically stacked in said receptacle; and a plurality of fastening members directly positional through said rear portion and into a wall surface for supporting said receptacle at an elevated position.

2. The apparatus of claim 1, wherein a volume of said front portion is less than a volume of said rear portion.

3. The apparatus of claim 1, wherein said front portion has a longitudinal height less than a longitudinal height of said rear portion such that a user can easily position said clips in the slot of said front portion.

4. The apparatus of claim 1, wherein said sock clips comprise:

a plurality of pivotally connected and coextensive jaw members, said jaw members being adaptable between open and closed positions; and an annular disc having a monolithically formed shaft protruding orthogonally therefrom, said shaft being directly conjoined to said jaw members;

wherein said disc is suitably sized and shaped such that a user can removably and slidably position said clips within the slot.

5. The apparatus of claim 1, wherein said front and rear portions each have a face providing a generally concave shape such that said clips lay juxtaposed in the slot to provide increased storage capability and easy access.

6. A sock organizing apparatus for sorting and washing paired socks, said apparatus comprising:

a receptacle having monolithically formed and bifurcated front and rear portions, each said front and rear portions including a top section having an opening formed therein and defining a cavity, said front portion having a slot formed medially therein and extending downwardly along a partial longitudinal height of said apparatus, said linear slot extending substantially parallel to a longitudinal axis of said receptacle;

a plurality of sock clips, said clips being formed from waterproof and heat resistant material, said clips being directly positional along the slot such that said clips are vertically stacked in said receptacle; and a plurality of fastening members directly positional through said rear portion and into a wall surface for supporting said receptacle at an elevated position.

7. The apparatus of claim 6, wherein a volume of said front portion is less than a volume of said rear portion.

8. The apparatus of claim 6, wherein said front portion has a longitudinal height less than a longitudinal height of said rear portion such that a user can easily position said clips in the slot of said front portion.

9. The apparatus of claim 6, wherein said sock clips comprise:

a plurality of pivotally connected and coextensive jaw members, said jaw members being adaptable between open and closed positions; and an annular disc having a monolithically formed shaft protruding orthogonally therefrom, said shaft being directly conjoined to said jaw members;

wherein said disc is suitably sized and shaped such that a user can removably and slidably position said clips within the slot.

10. The apparatus of claim 6, wherein said front and rear portions each have a face providing a generally concave shape such that said clips lay juxtaposed in the slot to provide increased storage capability and easy access.

11. A sock organizing apparatus for sorting and washing paired socks, said apparatus comprising:

a receptacle having monolithically formed and bifurcated front and rear portions, each said front and rear portions including a top section having an opening formed therein and defining a cavity, said front portion having a slot formed medially therein and extending downwardly along a partial longitudinal height of said apparatus, said linear slot extending substantially parallel to a longitudinal axis of said receptacle, said slot having a closed bottom-most end terminating above a bottom-most end of said receptacle;

a plurality of sock clips, said clips being formed from waterproof and heat resistant material, said clips being directly positional along the slot such that said clips are vertically stacked in said receptacle, said sock clips being prohibited from axially reaching said bottom-most end of said receptacle while said sock clips are seated within said slot; and a plurality of fastening members directly positional through said rear portion and into a wall surface for supporting said receptacle at an elevated position.

12. The apparatus of claim 11, wherein a volume of said front portion is less than a volume of said rear portion.

13. The apparatus of claim 11, wherein said front portion has a longitudinal height less than a longitudinal height of said rear portion such that a user can easily position said clips in the slot of said front portion.

14. The apparatus of claim 11, wherein said sock clips comprise:

a plurality of pivotally connected and coextensive jaw members, said jaw members being adaptable between open and closed positions; and an annular disc having a monolithically formed shaft protruding orthogonally therefrom, said shaft being directly conjoined to said jaw members;

wherein said disc is suitably sized and shaped such that a user can removably and slidably position said clips within the slot.

15. The apparatus of claim 11, wherein said front and rear portions each have a face providing a generally concave shape such that said clips lay juxtaposed in the slot to provide increased storage capability and easy access.

* * * * *